United States Patent [19]

Nagel et al.

[11] 4,029,249

[45] June 14, 1977

[54] ROLLER SYSTEM FOR CONTINUOUS TRANSPORT OF WEBS OF SHEETING

[75] Inventors: Peter Nagel; Werner Grau, both of Willstaett; Hermann Maier, Ludwigshafen; Heinrich Wittkamp, Mannheim; Roland Falk, Achern; Paul Willmann, Renchen, all of Germany

[73] Assignee: BASF Aktiengesellschaft, Ludwigshafen, Germany

[22] Filed: Sept. 12, 1975

[21] Appl. No.: 612,757

[30] Foreign Application Priority Data

Sept. 12, 1974 Germany ..... 2443663

[52] U.S. Cl. ..... 226/95; 226/193; 29/121.2

[51] Int. Cl.[2] ..... B65H 17/30

[58] Field of Search ..... 226/95, 190, 193; 29/121 R, 121 A

[56] References Cited

UNITED STATES PATENTS

| | | | |
|---|---|---|---|
| 1,603,763 | 10/1926 | Griffin | 226/193 |
| 3,122,295 | 2/1964 | Davison et al. | 226/193 |
| 3,630,424 | 12/1971 | Rau | 226/95 |
| 3,821,076 | 6/1974 | Stenberg et al. | 29/121 A |

*Primary Examiner*—Robert W. Saifer
*Attorney, Agent, or Firm*—Keil, Thompson & Shurtleff

[57] ABSTRACT

A high-speed roller system for transporting webs of sheeting, preferably for coating the same with a magnetic layer, comprising a suction roller for control of the speed of the web, which suction roller has a surface containing grooves, preferably rhombic grooves, in which the perforations for sucking the sheeting are disposed, preferably at the points of intersection, the ratio of the total cross-sectional area of the perforations to the total surface area of the roller being from 0.7 to 3%.

4 Claims, 4 Drawing Figures

ROLLER SYSTEM FOR CONTINUOUS TRANSPORT OF WEBS OF SHEETING

This invention relates to an apparatus for continuous transport and acceleration and deceleration of webs of sheeting by means of a plurality of rollers including a suction roller acting as a control point, which roller system is preferably designed for use in conjunction with high-speed coating machines for thin sheeting, particularly for coating base film with magnetizable dispersions.

In the manufacture of magnetic tapes, the base film runs from the supply roll, for example via a washing and coating unit, and through subsequent drying channels, testing units and calender to the take-up roll at high speed. On account of the overall length of the line and the sensitivity of the film, which does not permit the use of high tension, and also on account of the high film speed required for reasons of economy, it is generally necessary to make use of a plurality of driving stations in order to transport the web over all of the functional stations. Furthermore, it is necessary to provide a specific tension at some given points in the line in order to keep the web free from creases.

It is known to guide and control sheeting by means of nip rollers consisting of a pair of rollers, one of steel and the other rubber-coated, in conjunction with appropriate driving units. However, when the sheeting passes round rubber rollers, there is always the risk of blocking of the sheeting, this giving rise to the formation of creases. Creases are also frequently caused by poor adjustment or a change in the adjustment of the pair of rollers having unlike surfaces or by dirt on the rubber coating. Frequently, such dirt eventually causes damage to thin sheeting under the action of the pressure applied. By contrast, the use of single suction rollers is less damaging to the sheeting and the risk of dirt is low on account of the metal surface. There are also no problems of adjustment, since there is no second roller to apply a nip pressure. Prior art suction rollers are only suitable for use with sheeting having a thickness of more than 50 $\mu$ and used at low speeds of, say, less than 100 m/min, this being on account of the design of said rollers. The adhesion forces applied to the web of sheeting are created in such suction rollers via the smooth perforated surface thereof, the multichamber construction of the interior of the roller in conjunction with a control disk at one end of the roller transmitting the suction force successively to only partial areas of the roller surface. Tests have shown that it is not possible to transport thin webs of sheeting at speeds of more than from 100 to about 150 m/min without the formation of creases using prior art suction rollers having smooth surfaces, and it is equally impossible, if and when required, to accelerate or decelerate such sheets at a specific control point using such a roller. In addition, the leakage losses of the vacuum at high speeds are unduly high, i.e. involve too much energy expenditure, even when the looping angle is about 300°.

It is an object of the invention to provide a suction roller which fulfills the above requirements with a minimum of energy expenditure as regards the vacuum. Furthermore, it is desirable for the noise made by the web of sheeting when passing over the suction roller to be as low as possible.

We have found a solution to said problem arising in a roller system comprising at least one suction roller acting as speed control point for the sheeting; which is thin film coated with a magnetizable layer and having a thickness of less than 50 $\mu$ and preferably of 4 to 20 $\mu$, the web speeds used being more than 20 m/min and preferably from 40 to 200 m/min at sheeting tensions of 1 to 20 kg per 650 mm of web width, in that the following design of suction roller is used:

a. the surface of the roller is grooved,
b. the surface of the roller is perforated in such a manner that the perforations are situated in said grooves, and
c. the ratio of the total cross-sectional area of the perforations to the effective surface area of the roller is at least 0.7 %, not more than 3% and preferably from 0.9 to 2%.

The degree of roughness of the suction roller between the grooves is from 3 to 10 $\mu$ and preferably from 5 to 7 $\mu$.

According to another essential feature of the invention, the surface of the roller has a rhombic pattern of grooves, the perforations being located at the points of intersection of the grooves.

Figure 1:
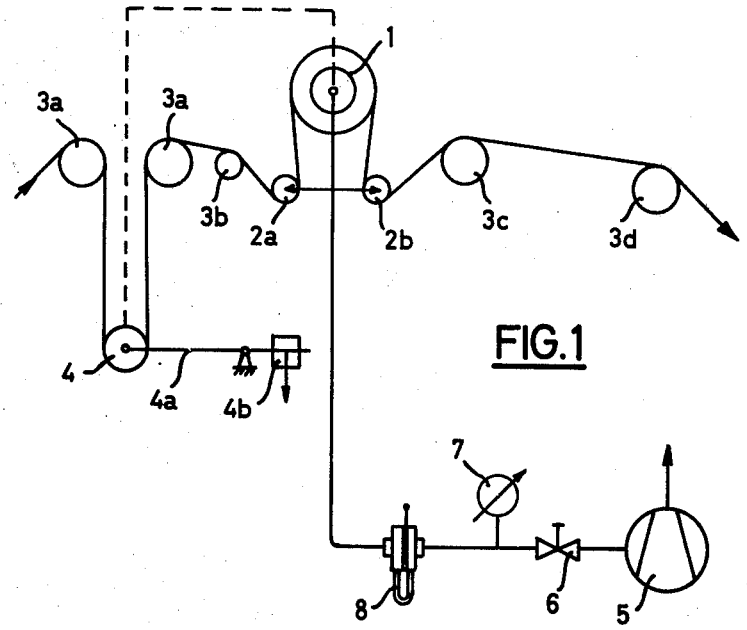
FIG. 1 is a diagrammatic representation of a roller system for a magnetic tape coating plant.

FIG. 1 of the accompanying drawings is a diagrammatic illustration of a roller system for a magnetic tape coating plant, the supply and take-up stations at each end not being shown. The control point, i.e. the point at which the web speed and the tensile forces are controlled and accelerations and decelerations are caused if necessary, is the driven suction roller 1, with which the guide rollers 2*a* and 2*b* are associated, the position of which relative to each other can be changed in order to alter the looping angle at the suction roller. The other rollers 3*a* to 3*d* may only serve to guide and support the sheeting over its route. The compensating roller 4, which is pivotally mounted to a 2-armed lever 4*a* and is balanced by an adjustable weight 4*b*, compensates for fluctuations in speed and tension in the manner usually employed for the control of loops of tape. The movements of the compensating roller 4 preferably influence the drive of the suction roller 1. If $Z_o$ is taken to be the required tension of the sheeting leaving the suction roller 1 and Z is taken to be the actual tension in the sheeting at some point upstream of the suction roller, the relationship $Z_o > Z$ indicates a loss of tension or a braking action on the moving web, whilst the relationship $Z_0 < Z$ indicates an increase in tension or an acceleration of the moving web. For the generation of an constant control of suction applied to the internal chamber system of the vacuum roller 1, there is provided a liquid-seal pump 5, a constricting element 6, a manometer 7 and, conveniently, an orifice 8.

A number of types of roller were tested in order to solve the problem of controlled transport of sheeting having a thickness of less than 50 $\mu$ and preferably of from 4 to 20 $\mu$ through the coating plant at speeds of more than 40 m/min up to 200 m/min by means of a suction roller using sheet tensions ranging from 1 to 20 kg per 650 mm of web width. It was found that not only the diameter but also the surface properties of the roller and the ratio of the total cross-sectional area of the perforations to the total effective surface area of the roller are important factors for achieving maximum speeds of travel at a minimum of energy expenditure as regards the suction applied. The proviso made is that no creases are formed in the sheeting either at constant speeds or during accelerations or decelerations, within the range of permissible tensile forces (web tensions).

Figure 2:
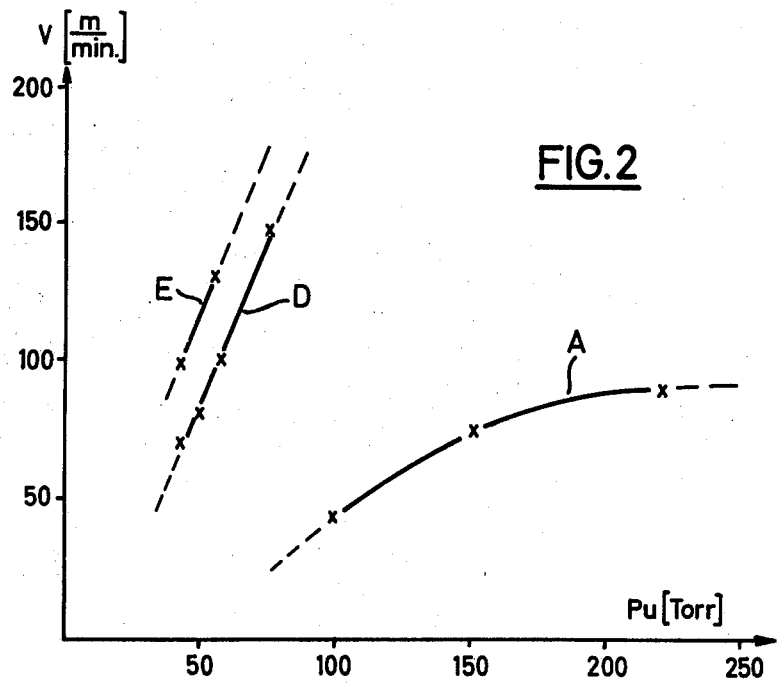
FIG. 2 is a graph in which the speed has been plotted against the vacuum applied for the three types of roller tested.

FIG. 2 contains graphs of speed plotted against vacuum for three types of roller tested.

Graph (A) relates to a perforated roller having a smooth surface and a diameter of 150 mm, the diameter of the perforations being 1 mm. The ratio (*f*) of total cross-sectional area of perforations to the effective surface area is 0.35%.

Graph (D) relates to a perforated roller having a diameter of 150 mm and perforations of 1 mm in diameter. The surface of this roller is provided with grooves having a cross-section measuring 0.5 × 4 mm and arranged parallel to the axis of the roller. The perforations are located in every other groove. The ratio (*f*) is 0.74%.

Figure 3:
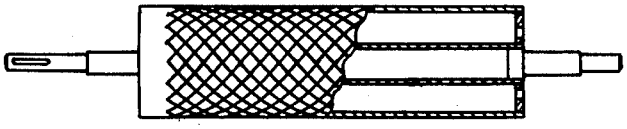
FIG. 3 is a schematic side elevation of a roller having a rhombic pattern of grooves, with a part thereof broken away in order to show the interior of the roller.
Figure 3A:
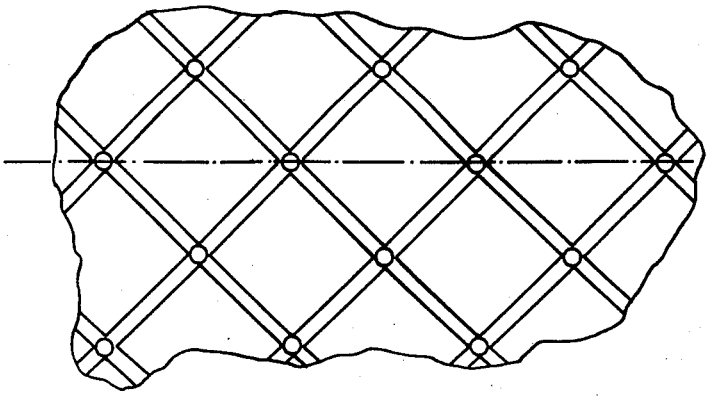
FIG. 3*a* is an enlarged plan view of a segment of the surface of the roller of FIG. 3.

Graph (E) relates to a perforated roller having a diameter of 200 mm and perforations of 2.5 mm in diameter. The surface of the roller is provided with a rhombic pattern of grooves measuring 0.5 × 2 mm in cross-section. The ratio (*f*) is 1.6%. The perforations are situated at the points of intersection of the grooves (see FIGS. 3 and 3*a*).

The rollers A, D and E tested and represented by the associated graphs constitute a selection only. Other tests related to the influence of the degree of roughness of the roller surface between the parallel or rhombic grooves and to the amount of air sucked in by the various rollers. All tests have shown that maximum speeds of only about 90 m/min are possible using a perforated roller having a smooth surface. To achieve steady transport of the sheeting over these rollers without creasing, however, it is necessary to apply vacuums of 230 mm of Hg and the amount of air sucked in is more than 200 $m^3/h$. By contrast, the grooved rollers D and E gave much better results as regards energy expenditure and could be driven to give steady, crease-free transport of the web of sheeting at speeds of more than 150 m/min.

We claim:

1. An apparatus for transporting and accelerating or decelerating webs of thin sheeting by means of a number of rollers, said apparatus comprising:

a suction roller having a rotational axis, said roller acting as a control point and having a rhombic pattern of grooves formed on its surface, said grooves being obliquely disposed with respect to the axis of said roller perforations formed on said surface at the points of intersection of said grooves, and the ratio of total cross-sectional area of said perforations to the effective surface area of said roller being at least 0.7 to not more than 3%.

2. The apparatus as set forth in claim 1 wherein the surface of said roller between the grooves has a surface roughness of from 3 to 10 microns.

3. The apparatus as set forth in claim 1 wherein said thin sheeting has a thickness of less than 50 microns.

4. The apparatus as set forth in claim 1 wherein said sheeting is driven at speeds of more than 20 m/min at web tensions of from 1 to 20 kg per 650 mm of web width.

* * * * *